United States Patent [19]

Mizelle

[11] 4,098,485

[45] Jul. 4, 1978

[54] SWIVEL APPARATUS

[75] Inventor: Ned W. Mizelle, Lexington, Ky.

[73] Assignee: Hoover Ball and Bearing Company, Saline, Mich.

[21] Appl. No.: 702,137

[22] Filed: Jul. 2, 1976

[51] Int. Cl.[2] ..... F16M 13/00

[52] U.S. Cl. ..... 248/425; 297/349; 308/238

[58] Field of Search ..... 108/139; 248/415, 425, 248/349; 297/349; 308/165, 227, 238, DIG. 7

[56] References Cited

U.S. PATENT DOCUMENTS

| | | | |
|---|---|---|---|
| 734,171 | 7/1903 | Hamilton | 308/165 X |
| 1,951,982 | 3/1934 | Kaiser et al. | 248/425 |
| 2,914,793 | 12/1959 | McMahan | 108/139 X |
| 3,572,817 | 3/1971 | Colautti et al. | 248/425 X |
| 3,593,954 | 7/1971 | Ritchie et al. | 248/425 |
| 3,860,283 | 1/1975 | Colautti | 248/425 X |

FOREIGN PATENT DOCUMENTS

| | | | |
|---|---|---|---|
| 481,785 | 3/1952 | Canada | 297/349 |
| 570,885 | 2/1933 | Fed. Rep. of Germany | 248/425 |

*Primary Examiner*—Lawrence J. Staab
*Attorney, Agent, or Firm*—Olsen and Stephenson

[57] ABSTRACT

Swivel apparatus for a chair or the like comprising nonmetallic bearing members rotatably supporting a swivel plate. The bearing members are mounted in fixed positions on a support and each has a laterally disposed arcuate groove located in interfitting engagement with a circular projecting extension on the chair mounted swivel plate so as to rotatably support the swivel plate.

5 Claims, 5 Drawing Figures

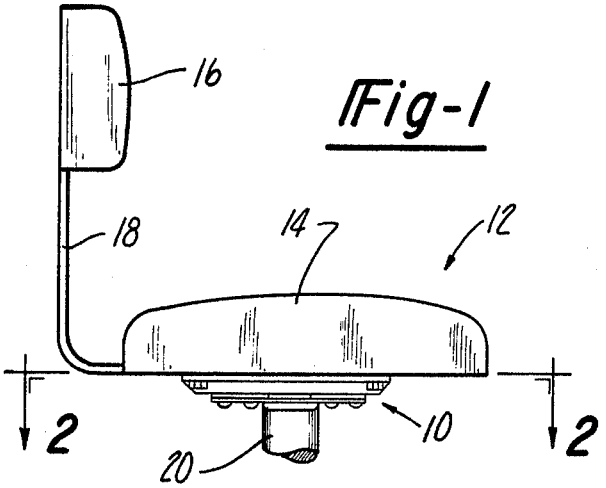
Fig-1
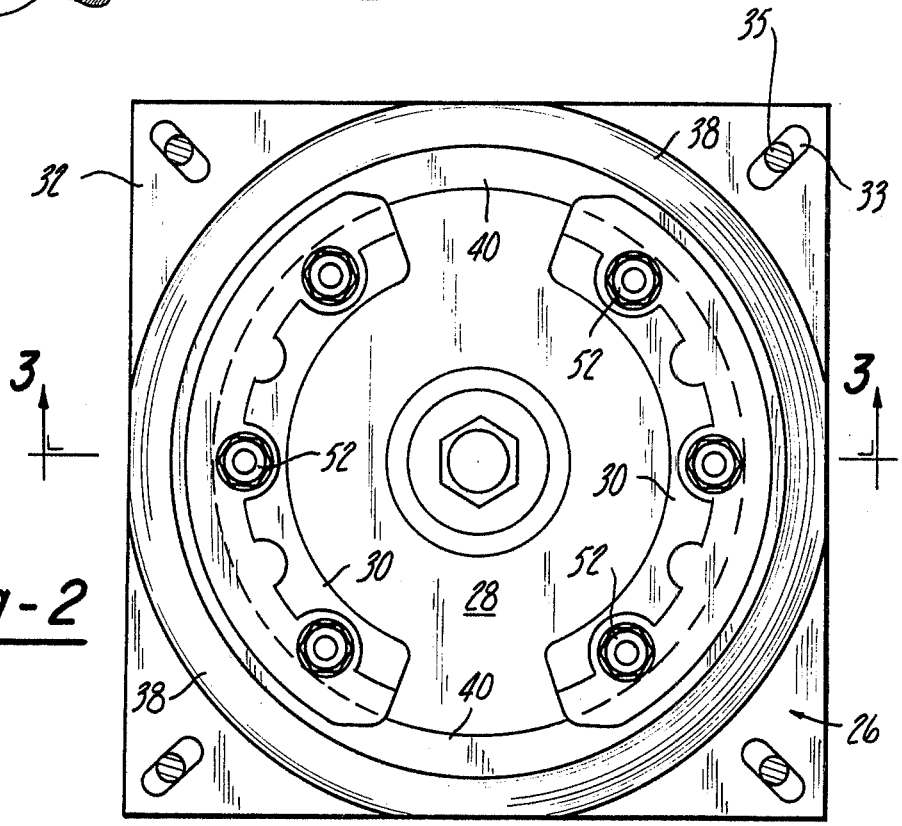
Fig-2
Fig-3
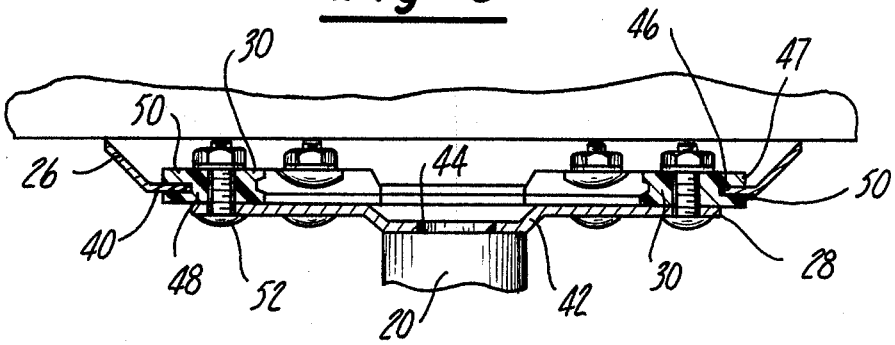

SWIVEL APPARATUS

BACKGROUND OF THE INVENTION

The present invention relates generally to swivel mechanisms and more specifically to an improved rotatable swivel mechanism useable in chairs and the like.

Swivel chairs, such as office chairs, stools or the like, generally have swivel mechanisms consisting of opposing plate members and ball bearings located in raceways formed in the plates for swiveling the chair in opposite directions. These mechanisms usually include additional structure to maintain the plates in their opposed positions. Applicant has invented a swivel apparatus which provides effortless rotation between opposing plates without the use of conventional ball bearings and in which the bearing means used functions to positively connect the plates.

SUMMARY OF THE INVENTION

In accordance with the present invention, a swivel apparatus for a swivel-type chair is provided consisting of a pair of bearing bodies mounted on a support and rotatably supporting a swivel plate. The bearing bodies are formed of nonmetallic material having low coefficient of friction properties and are secured to the lower support plate. An arcuate-shaped groove is formed around the periphery of each bearing body and corresponds to an integrally formed projecting circular extension on an upper swivel plate. The extension interfits with the grooves to provide a rotatable connection between the upper and lower support plates. Thus, the bearing bodies function both to rotatably interconnect the plates and to provide a low frictional engagement for effortless relative swiveling of the plates.

The present invention thus provides swivel apparatus having an improved rotatable connection and formed from a minimum number of parts which are readily fabricated and assembled.

Further objects, features and advantages of the present invention will become apparent from a consideration of the following description when taken in connection with the appended claims and the accompanying drawing in which:

FIG. 1 is a side elevational view of a swivel chair incorporating one form of the swivel apparatus of the present invention;

FIG. 2 is a top plan view of the swivel apparatus taken at substantially line 2—2 in FIG. 1;

FIG. 3 is a fragmentary sectional view of the swivel apparatus taken substantially from line 3—3 in FIG. 2;

Figure 4:
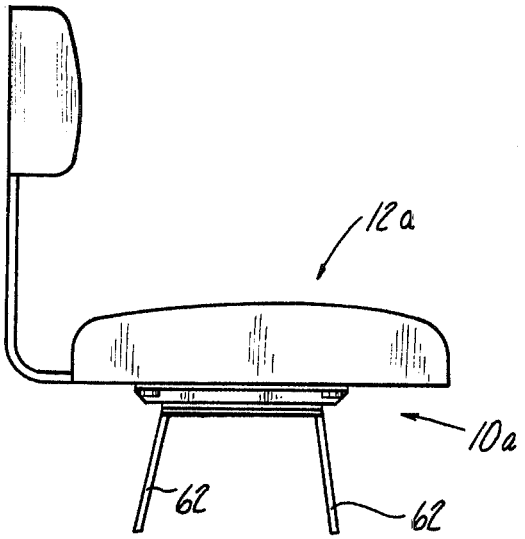
FIG. 4 is a side elevational view of a chair incorporating another form of the swivel apparatus of this invention.

Referring to the drawing, one form of the swivel apparatus of the present invention, indicated generally at 10, is shown in FIG. 1 installed in a swivel chair 12. The chair 12 consists of a seat 14 and a backrest 16 connected to the seat 14 by a support member 18. The seat 14 is mounted by the swivel apparatus 10 on a pedestal 20.

As shown in FIG. 2, the swivel apparatus 10 consists of bearing means which rotatably connect an upper swivel plate 26 to a coaxially positioned lower support plate 28. The swivel plate 26 includes flat flange portions 32 provided with slots 33 through which bolt assemblies 35 extend to secure the plate 26 to the underside of the seat 14. A projecting circular extension 38 extends downwardly and inwardly from the periphery of the upper plate 26 and terminates in a substantially horizontal flat border portion 40, as viewed in FIG. 3. The inside edge of the border portion 40 defines a circle (FIG. 2) and the border portion 40 interfits with the bearing means to provide rotatable connection between the upper and lower plates 26 and 28, respectively.

The lower plate 28 is formed having a downwardly extending hub portion 42 with a central opening 44. The lower plate 28 can be attached to the chair base 20 such as by welding or by extending a bolt assembly (not shown) through the opening 44. The bearing means includes a pair of generally opposed plastic bodies 30 exhibiting low coefficient of friction properties. The bearing bodies 30 are formed to an arcuate shape and are secured to the lower support plate 28 by a plurality of bolt assemblies 52. An arcuate groove 46 is formed on the radially outer sides 47 of the bodies 30 and has an upright wall 48 and transversely extending upper and lower walls 50. The border portion 40 is restrained in the groove 46 to provide the rotatable connection between the upper and lower plates 26 and 28. The thickness of the border portion 40 substantially equals the distance between the upper and lower walls 50 so that when the swivel mechanism is fabricated a secure rotatable connection between the upper and lower plates 26 and 28 is achieved which provides effortless swiveling of the mechanism. In addition, the inside edge of the border portion 40 is positioned adjacent to the upright walls 48 of the grooves 46 to prevent undesirable lateral movement of the plates relative to each other.

The upper and lower plates 26 and 28 can be formed from a single rectangular piece of plate stock. The circular lower plate 28 is punched from the plate stock and is further worked to form its hub 42 and the necessary bolt holes. The remaining plate stock becomes the upper plate 26 and is worked to form the projecting circular extension 38. Thus, the diameter across the lower plate 28 is substantially equal to the diameter between opposite sides of the inside edge of the border 40. Lower production costs result from such efficient utilization of stock material.

Figure 5:
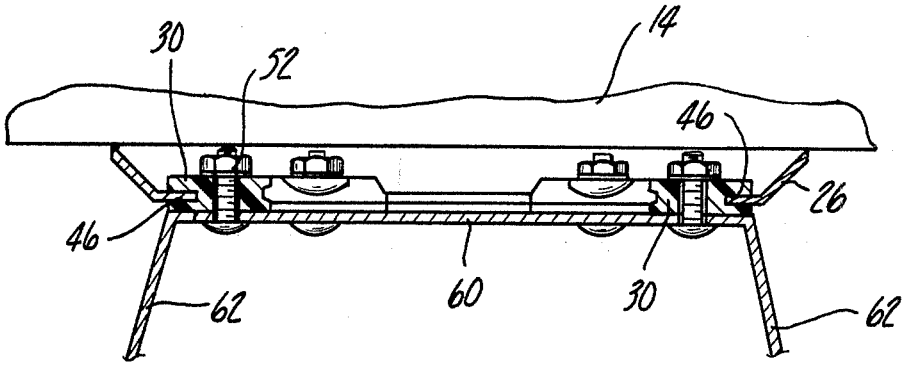
FIG. 5 is a sectional view, like FIG. 3, of the other form of the swivel apparatus.

Another form of the swivel apparatus of this invention, indicated generally at **10*a* is shown in FIGS. 4 and 5 incorporated in a swivel chair 12*a*. The apparatus 10*a* is identical to the apparatus 10 is all respects except as follows. In the apparatus 10*a* the lower support 60 for the bearing bodies 30 is an integral part of the support structure for the chair 12*a*. For this reason, the support 60 is shown with downwardly extending legs 62. Thus, in the apparatus 10*a* the separate support plate 28** is not necessary.

From the above description, it can be seen that this invention provides improved swivel apparatus 10 and **10*a* having a pair of bearing bodies 30 providing a rotatable support for a chair seat mounted plate 26. The bearing bodies 30 consist of nonmetallic material having low coefficient of friction properties and are readily supported from below. A groove 46 is formed on the sides of the bearing bodies 30 in which a projecting extension 38 on the swivel plate 26 is positioned to rotatably support the chair seat. The result is a compact, freely movable swivel 10 or 10*a* which can readily be fabricated and assembled at low cost. The swivels 10 and 10*a*** can then be readily installed in any desired environment in which they will perform efficiently over a prolonged service life.

What is claimed:

1. Swivel apparatus comprising a plurality of bearing bodies, support means secured to said bearing bodies maintaining said bodies in fixed positions, each of said bearing bodies having an arcuately shaped side having generally horizontal arcuate groove means formed therein, a swivel plate, and a horizontally projecting circular extension on said swivel plate projecting radially inwardly into said groove means to be slidably engaged therein, said extension being arranged in a coaxial relation with said groove means to be restrained in said groove means so as to rotatably support said swivel plate on said bearing bodies.

2. Swivel apparatus according to claim 1 further including a plurality of bolt assemblies fixedly attaching said bearing bodies to said support means in generally diametrically opposed positions.

3. Swivel apparatus according to claim 2 wherein said groove means has an upright inner wall and transversely extending upper and lower walls, said projecting extension being of a thickness substantially equal to the distance between said upper and lower walls.

4. Swivel apparatus according to claim 3 wherein said support means comprises a lower support plate of a circular configuration having a diameter substantially equal to the inner diameter of said circular extension.

5. Swivel apparatus according to claim 3 wherein said support means comprises a chair support structure.

* * * * *